United States Patent [19]

Norton

[11] Patent Number: 4,619,735

[45] Date of Patent: Oct. 28, 1986

[54] METHOD OF RETARDING PAPER DEGRADATION WITH TIME BY TREATMENT WITH MELAMINE, AND METHOD OF PRODUCING AGEING-RESISTANT PAPER COATED WITH MELAMINE

[75] Inventor: Richard V. Norton, Columbus, Ohio

[73] Assignee: Melamine Chemicals, Inc., Donaldsonville, La.

[21] Appl. No.: 701,153

[22] Filed: Feb. 13, 1985

[51] Int. Cl.[4] ..... D21H 1/28

[52] U.S. Cl. ..... 162/135; 162/158; 162/160; 162/207; 252/401; 422/1; 422/28; 427/395

[58] Field of Search ..... 162/158, 160, 207; 422/1, 28; 162/135; 427/395; 252/401

[56] References Cited

U.S. PATENT DOCUMENTS

| | | | |
|---|---|---|---|
| 3,102,159 | 8/1963 | Ford | 162/160 |
| 3,595,688 | 7/1971 | Sadler | 162/160 |
| 4,522,843 | 6/1985 | Kundrot | 162/160 |

FOREIGN PATENT DOCUMENTS 1281896 12/1961 France .

*Primary Examiner*—Peter Chin
*Attorney, Agent, or Firm*—A. W. Breiner

[57] ABSTRACT

Degradation of paper is retarded by treating paper with melamine. Method of treating existing paper with melamine to stop or retard degradation and methods for inclusion of melamine in paper as made to provide an age resistance paper are described. Rare books, paintings and prints can be preserved or books, paintings and prints as originally formed can use melamine-treated paper to retard degradation.

9 Claims, 1 Drawing Figure

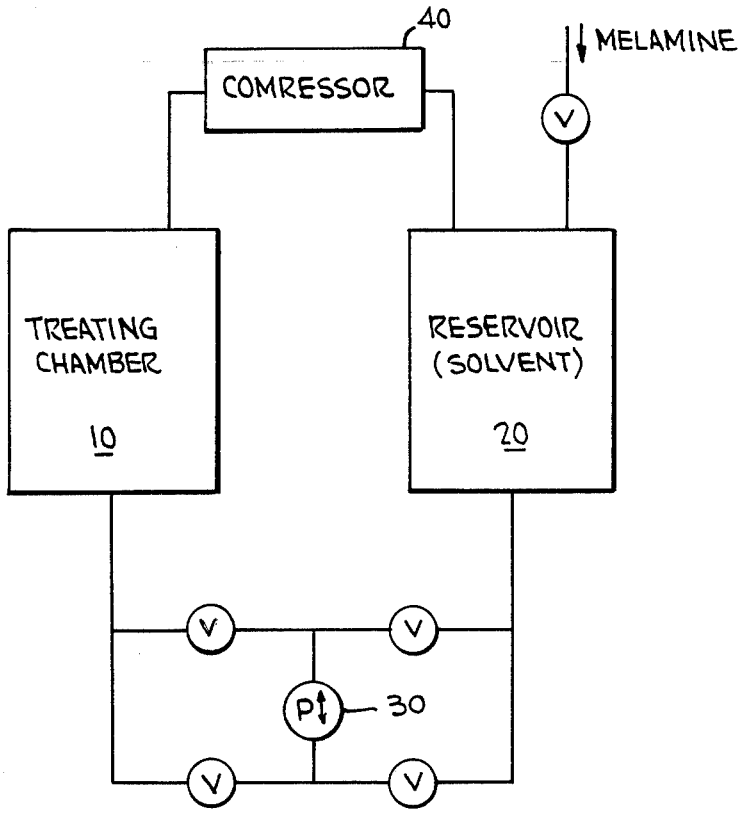
40
COMRESSOR
MELAMINE
V
TREATING CHAMBER
10
RESERVOIR (SOLVENT)
20
V
V
P
30
V
V

METHOD OF RETARDING PAPER DEGRADATION WITH TIME BY TREATMENT WITH MELAMINE, AND METHOD OF PRODUCING AGEING-RESISTANT PAPER COATED WITH MELAMINE

FIELD OF INVENTION AND BACKGROUND

This invention relates to paper products of the type used in books, paintings and the like, and to the preserving of such paper products. More particularly, this invention relates to paper products containing melamine which resist degradation over time, and to methods of treating paper products with melamine to preserve the paper products.

Paper such as paper used in books, paintings and prints of paintings, including mats used in framing paintings and prints, are known to degrade over a period of time. This degradation is commonly accepted to be a result of a slow chemical reaction of the paper or components used in the process of making the paper, in situ, or with components of the atmosphere. It has been found that paper made with certain chemical processes is particularly susceptible to degradation over time, whereas paper made with other chemical processes such as the caustic soda process withstand degradation over time better than most other types of papers. It is believed that the degradation is a result of the acidic nature common to many papers or to acids present in the atmosphere, accounting for the slower degradation of paper made utilizing highly caustic conditions of certain processes such as the caustic soda process which destroy most acids which may be present in the paper when made or which are picked up from the atmosphere.

Paper degradation over time is a particularly serious problem with respect to rare books, precious paintings and prints, and historical documents. Museums commonly resort to extreme measures such as isolating the valuable and rare paper products from the atmosphere, or maintaining constant temperature and pressure conditions where such paper products are retained, all at substantial time and expense.

Degradation of paper products, however, is also a serious problem with respect to personal property, including family heirlooms such as the family Bible, pictures, and other papers having only personal and sentimental value. These items normally cannot be protected privately using the extreme measures available to museums and other institutions where public documents are preserved.

PRIMARY OBJECTS AND GENERAL DESCRIPTION OF INVENTION

It is a primary object of the present invention to provide a simplified and relatively inexpensive method of treating existing paper products such as books, paintings, prints of paintings, or other rare documents to preserve the products from degradation over time.

It is another primary object of this invention to provide a method of treating existing paper to be used in books and the like to resist degradation, over time, of the book or the like printed on the paper.

It is still another object of the present invention to provide paper as manufactured which has a high resistance to degradation over time.

The above and other objects of this invention will become more apparent from the following description of the invention with particular emphasis on the examples which are the presently preferred embodiments of the invention.

It has been discovered according to the present invention that melamine and certain melamine derivatives when it contacts with paper will preserve the paper from degradation over time. More specifically, it has been found that melamine or a select derivative thereof, incorporated into paper at the time the paper is made in some step of the papermaking process so as to provide paper containing melamine, will provide paper having a surprisingly increased resistance to degradation on ageing of the paper. It has also been found that existing paper when treated with melamine or certain derivatives of melamine will stop or retard the ageing or degradation process of the paper. It is believed that in the case of paper having melamine or a derivative thereof incorporated at the time of manufacture, the melamine or a derivative thereof will neutralize any acid present in the components of the papermaking process, and further neutralizes acidic components from the atmosphere which may contact the paper, thereby stopping or retarding degradation. In the case of an existing paper product, such as a book, the treatment with melamine or a derivative thereof is believed to destroy acidic components within the paper and also protect the paper from harmful components in the atmosphere which may contact the paper. The present invention therefore provides a convenient, relatively inexpensive method of preserving new and existing paper products from ageing or degradation over time.

It is not completely understood why melamine and certain of its derivatives have the unique effect that they do in the preservation of paper. It is believed, however, that certain characteristics of melamine are particularly advantageous. Thus, melamine is a solid hydrolytically stable to moisture. Additionally, melamine has no odor, a low vapor pressure, yet it has a real vapor pressure which will permit melamine to vaporize and diffuse to or into another substrate. Melamine has a high degree of amine functionality as is apparent from the structural formula of melamine, as follows:

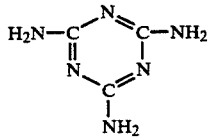

It is believed to be this strong amine functionality in a solid material which has a low vapor pressure, but yet a real vapor pressure, which provides the unique paper preserving characteristics whether within the structure of the paper or in mere contact with the paper. Melamine is further unique in that it is non-toxic and non-reactive to the artistic medium of a book, paintings, etc., i.e., it is non-reactive with inks, paints, or the like, which are present in most papers which are to be preserved. Further, melamine does not degrade paper upon contact with melamine. It is possible that the unique characteristics of melamine also depend upon its s-triazine structure. However, it has been found that compounds which are not hydrolytically stable, such as urea, or s-triazine compounds which have acidic characteristics, such as cyanuric acid, will not perform the same function. Melamine derivatives which will function are ammeline $C_3N_5H_5O$; melam $C_6H_9N_{11}$; melem $C_6H_6N_{10}$; and melamine which contains low levels of melamine derivatives such as melem, melam, etc., formed during the manufacture of the melamine. Melamine of this type is described in commonly assigned Thomas and Best, U.S. patent application Ser. No. 568,408 filed Jan. 5, 1984, assigned to Melamine Chemicals, Inc. The product is sold under the trademark MELAMINE II. Low molecular weight melamine-formaldehyde monomers having at least one free functional amine group can also be utilized.

In the treatment of an existing paper product, whether it is new paper to be used in a paper product or paper already in the form of a book or other paper product, a preferred method is to place the paper product such as a book in an autoclave. The autoclave is flooded with a gaseous medium such as super-critical carbon dioxide or Freon saturated with melamine or a select derivative thereof, so as to cause the gas carrying melamine to permeate the paper article. The melamine is believed to withdraw and/or neutralize the acidic components of the paper while leaving a superficial coating of melamine on the paper which further protects the paper product from degradation over time. The amount of melamine carried in the liquid is not overly critical, but preferably is in an amount from about 0.1 to 10% of the liquid volume, with the optimum amount being about 3% to 7% melamine of the liquid volume. It is only necessary that the melamine be present in an amount so as to contact or permeate the paper, and leave a superficial coating of the melamine on or within the paper. The amount of melamine deposited is believed to be no more than about 3 to 9 parts per million per square centimeter of paper surface. It is essential, however, that the paper does have melamine at the surface of the fibers or is in contact with a surface containing free melamine.

The melamine can also be incorporated in paper at the time the paper is manufactured to provide a paper which resists degradation due to ageing. The melamine can be incorporated at various steps of the paper pulping or manufacturing process. It has been found, however, that although melamine has been suggested as a pulping aid, melamine added during the pulping stage of the paper manufacture is not effective in preserving paper in that the melamine either reacts with the components of the paper pulp, such as the cellulose or the lignin which is present in paper pulp; or it is washed out during the pulping process. The paper, therefore, does not retain sufficient melamine in the paper to provide the preservative effect desired according to the present invention. It is preferred, therefore, that the melamine be applied at one of the later stages of the papermaking process, preferably in a final stage. The amount of melamine utilized in the treatment of the paper during the papermaking process is not overly critical. However, the amount used must be sufficient to provide free melamine on the paper. Normally the paper will contain from about 3 to 9 parts melamine per million per square centimeter of paper. It has been found that within reason the larger the amount of melamine present on the paper, the longer will be the preservation effect.

It has also beeh determined that it is desirable at times to pretreat the paper with a bleaching agent prior to treating with melamine. Thus, it is advantageous at times to treat the paper with a sulfite or a chlorine bleach. Bleaches are believed to help open up the sites in the paper for reaction with or for maintaining contact with the melamine. In any event, it can be advantageous to bleach the paper and then follow the bleaching with treatment with melamine.

According to the present invention, therefore, there is provided a process for treating paper to preserve the paper and to provide a paper which is highly resistant to ageing and degradation. The melamine or select derivative thereof used as the treating agent can be put into the paper during the papermaking process provided the amount of melamine used is sufficient to have free melamine present on the paper produced. The free melamine will react with acidic components of the paper and/or with acids contained in the atmosphere, thereby stopping or retarding degradation. It is also possible to treat paper in existing books or the like with melamine whereby the melamine diffuses into the paper, permeating the entire book or the like. In the latter instance, the paper must have sufficient melamine in contact therewith to neutralize the acidic components within the paper and, preferably, to provide a thin coating or superficial coating available to neutralize any acidic gases within the atmosphere.

It is also possible to treat paper or paperboard, such as museum board used in mounting paintings or the like, with a sufficient amount of free melamine so that the melamine on the board when in contact with another paper product such as a substrate of a painting will diffuse into the paper of the painting and thus contact any acidic components in the paper and preserve the paper. This method of preservation has been found particularly effective and advantageous in preserving paintings of the type found in museums. However, the method is sufficiently inexpensive to preserve personal paintings, or prints, or the like, which have only limited value.

BRIEF DESCRIPTION OF THE DRAWING

The FIGURE shows a system for carrying out the invention method.

SPECIFIC AND PRESENTLY PREFERRED EMBODIMENTS

Having described the invention in general terms, the following presently preferred embodiments will illustrate the invention.

EXAMPLE 1

A 24"×36" section of museum board is soaked in a hot aqueous solution of melamine. The aqueous solution contains approximately 8% by weight melamine. After soaking, the museum board is withdrawn from the solution and dried without washing. The free melamine on the board, dry weight, is about 2% based on the weight of the board. The melamine on the board will preserve the board per se, and will also preserve paper in contact therewith and, thus, can serve as a mat for a painting or print.

EXAMPLE 2

A 24"×36" section of museum board is sprayed at one surface with a hot aqueous solution of melamine. The solution contains approximately 10% by weight of melamine. After spraying, the board is dried without washing. The board contained a melamine loading, dry weight, of about 1.1% based on the weight of the board, but 3.1% on the sprayed surface of the board. The museum board when utilized as a mat for a painting where the treated surface of the board is against the painting will provide better results than the museum board of Example 1 which contained only 2% by weight melamine.

EXAMPLE 3

A 24"×36" section of museum board is treated with an aqueous slurry of melamine, the melamine being present in the slurry at approximately 30%. The board is dried without washing. The free melamine on the board will have a loading, dry weight, of about 5% melamine based on the weight of the board. The 5% melamine is sufficient to provide a high degree of preservation of the board; and, further, the melamine when the board is used as a mat will diffuse into a paper such as a painting in contact with the museum board and thus will preserve such paper. It has been found as a general rule that the larger the amount of melamine without having the melamine powder or flake off the board, the longer the time of preservation. It is necessary, however, to have an amount on the mat sufficient to impart through diffusion at least about 0.1% of melamine into paper, i.e., a painting or print adjacent thereto in a reasonable period of time. For preferred and practical application, the amount of melamine on the mat will be in the range of about 0.5 to about 5%.

EXAMPLE 4

Paper pulp is manufactured using conventional papermaking techniques. Before the final drying of the finished paper, the paper is spray coated with a hot solution of melamine containing approximately 5% melamine in an aqueous solution. The finished paper contains a superficial coating of free melamine at the surface of the paper. The paper resists degradation when used in a conventional application such as in the printing of a book.

As will be apparent, the melamine can be applied to the paper at other stages in the papermaking process. It is critical, however, that the melamine not be tied up with other components of the paper such as cellulose or lignin, but remain as free melamine. Preferably, therefore, the melamine is utilized at one of the final stages of the papermaking process.

EXAMPLE 5

A book weighing approximately 1359 grams and containing approximately 1,000 papers was placed in a treating chamber as shown in the drawing of this application. The drawing is a flow diagram of a system used in treating existing papers to apply a melamine coating, including books.

After placing the book in treating chamber 10, liquid from reservoir 20 comprising 7 grams melamine per 1000 grams of super-critical carbon dioxide is pumped from the reservoir through pump means 30 into the treating chamber 10. The book is retained in the chamber while being flooded with the melamine containing liquid for five minutes. The valves from the reservoir were turned off, and the treating chamber evacuated by drawing the gaseous medium through compressor 40 to reservoir 20. It was found that a sheet of paper contained in the center of the book had deposited thereon a superficial coating of melamine. The coating of melamine is sufficient to retard the degradation of the paper.

In Example 5 the super-critical carbon dioxide can be replaced by other gases including Freon, ethylene, ethane, trifluorobromo methane, trifluorochloro methane, difluorochloro methane, difluorodichloro methane, monofluorodichloro methane, and nitrogen. Other gases can be utilized provided they have a critical temperature which permits the formation of a liquid at a relatively low temperature. Further, the amount of melamine contained in the solution can vary. Normally, however, the gas will contain from about 0.2% to about 1.5% melamine in the liquid medium.

As will be apparent to one skilled in the art, various modifications can be made within the scope of the aforesaid description. Such modifications being within the ability of one skilled in the art form a part of the present invention and are embraced by the appended claims.

It is claimed:

1. The method of treating existing paper products to retard degradation upon ageing over a prolonged time period comprising contacting existing paper with a super-critical solution of a melamine compound selected from the group consisting of melamine, ammeline, melam, melem, and mixtures thereof, to provide on said paper at least a superfical coating of said melamine compound, said coating being effective to retard the degradation of paper upon ageing over a prolonged time period.

2. The method of claim 1 wherein the existing paper being treated is a book.

3. The method of claim 1 wherein said melamine compound is melamine.

4. The method of claim 3 wherein said melamine is present in a super-critical solution of carbon dioxide.

5. The method of claim 3 wherein said melamine is present in a super-critical solution of fluorinated hydrocarbon.

6. The method of preserving a paper product from degradation comprising (1) providing a paper or paperboard mat having incorporated therein a free melamine compound selected from the group consisting of melamine, ammeline, melam, melem, and mixtures thereof in an amount sufficient to permit transfer; and (2) placing said product to be preserved adjacent to and in contact with said mat of step (1) whereby said melamine compound from said mat can diffuse into and contact said paper product in an amount sufficient to preserve said paper product.

7. The method of claim 6 wherein said melamine compound is melamine.

8. The method of claim 6 wherein said paper product is a painting.

9. The method of claim 6 wherein said paper product is a print of a painting.

* * * * *